United States Patent [19]

Ackley

[11] 4,377,971

[45] Mar. 29, 1983

[54] GRAVITY FED TYPE TWO-DRUM RECTIFYING AND ROTARY PRINTING SYSTEM

[76] Inventor: E. Michael Ackley, 1273 N. Church St., Moorestown, N.J. 08057

[21] Appl. No.: 231,227

[22] Filed: Feb. 2, 1981

[51] Int. Cl.[3] ..... B41F 17/36

[52] U.S. Cl. ..... 101/40; 198/377; 198/380; 221/173

[58] Field of Search ..... 101/38 R, 38 A, 39, 101/40, 110, 111, 426; 198/377, 380, 412; 221/171, 172, 173

[56] References Cited

U.S. PATENT DOCUMENTS

| | | | |
|---|---|---|---|
| 2,643,778 | 6/1953 | Socke | 198/412 X |
| 3,774,532 | 11/1973 | McKay | 101/111 |
| 3,871,295 | 3/1975 | Ackley | 101/426 |
| 3,902,413 | 9/1975 | Powell et al. | 101/111 |
| 3,917,055 | 11/1975 | Van den Berg et al. | 198/380 |
| 4,069,753 | 1/1978 | Ackley et al. | 101/40 |
| 4,104,966 | 8/1978 | Ackley, Jr. et al. | 101/40 |
| 4,167,226 | 9/1979 | Ackley et al. | 101/40 X |
| 4,208,962 | 6/1980 | Ackley, Sr. et al. | 101/40 X |
| 4,216,714 | 8/1980 | Ackley, Sr. et al. | 101/40 |
| 4,266,477 | 5/1981 | Ackley | 101/40 |
| 4,266,478 | 5/1981 | Ackley | 101/40 |
| 4,308,942 | 1/1982 | Ackley | 198/380 |

*Primary Examiner*—Edgar S. Burr
*Assistant Examiner*—Moshe I. Cohen

[57] ABSTRACT

An apparatus is disclosed which transports and rectifies objects, such as pharmaceutical capsules, and prints appropriate indicia on the objects. The apparatus comprises a two-drum system, the first drum being used to shift objects from a radial to a longitudinal position, and then to reorient some of the capsules so that, when the capsules are delivered to a second drum, the cam drum, all capsules are pointing in the same direction. The system takes advantage of gravity for rectification. Spin printing means are provided to print indicia on the rectified objects, as the objects travel along the periphery of the cam drum. A process for operating the apparatus is disclosed.

18 Claims, 5 Drawing Figures

GRAVITY FED TYPE TWO-DRUM RECTIFYING AND ROTARY PRINTING SYSTEM

BACKGROUND OF THE INVENTION

This invention relates to the field of transporting and rectifying of similar objects, especially pharmaceutical capsules. The invention comprises a method and apparatus for transporting the objects, and reorienting the objects such that they all point in substantially the same direction relative to their direction of motion, so that indicia can be printed on the objects.

There have been many efforts to solve the problem of the handling and printing of pharmaceutical capsules in the prior art. Reference is made to three applications filed by the present inventor, all co-pending with this application, which deal with the same general field. U.S. patent application Ser. No. 954,243, filed Oct. 24, 1978 now U.S. Pat. No. 4,266,477 discloses a two-drum apparatus. U.S. patent application Ser. No. 065,337, filed Aug. 9, 1979, now U.S. Pat. No. 4,266,478 discloses a three-drum capsule handling apparatus. U.S. patent application Ser. No. 089,190, filed Oct. 29, 1979, now U.S. Pat. No. 4,308,942 discloses a single-drum capsule handling apparatus. All three applications referred to above are hereby incorporated by reference into this application.

Prior workers in the art have developed apparatus capable of transporting, orienting, recitfying and in other appropriate ways positioning, etc. capsules such as are disclosed in the following U.S. patents, which may be considered representative of the prior art:

U.S. Pat. No. 2,785,786, R. J. Bartlett, CONVEYING APPARATUS
U.S. Pat. No. 2,859,689, A. Ackley, PELLET MARKING MACHINE
U.S. Pat. No. 2,931,292, C. E. Ackely, MARKING MACHINE
U.S. Pat. No. 2,982,234, C. E. Ackley and John Kane, METHOD OF PRINTING WAXED PELLETS, AND PRINTING INK
U.S. Pat. No. 3,026,792, J. J. Miskel et al, APPARATUS FOR BRANDING UNIFORMLY SHAPED ARTICLES
U.S. Pat. No. 3,042,183, C. E. Ackley, ARTICLE HANDLING APPARATUS
U.S. Pat. No. 3,200,556, C. E. Ackley, CAPSULE SEALING METHOD AND APPARATUS
U.S. Pat. No. 3,272,118, C. E. Ackley, ARTICLE MARKING MACHINE
U.S. Pat. No. 3,613,861, Alten E. Whitecar, CAPSULE ORIENTING MACHINE
U.S. Pat. No. 3,739,909, Garland et al, CAPSULE HANDLING APPARATUS AND METHOD
U.S. Pat. No. 3,838,766, Wagers, Jr. et al, CAPSULE INSPECTION APPARATUS AND METHOD
U.S. Pat. No. 3,868,900, Edward M. Ackley, CAPSULE PRECISION PRINTING APPARATUS AND METHOD
U.S. Pat. No. 3,871,295, Edward M. Ackley, CAPSULE ORIENTING APPARATUSAND METHOD OF SPIN PRINTING
U.S. Pat. No. 3,884,143, Edward M. Ackely, CONVEYOR LINK FOR TABLET PRINTING APPARATUS U.S. Pat. No. 3,912,120, Hoppmann et al, CENTRIFUGAL METHOD OF SORTING AND ORIENTING PARTICULATE ARTICLES
U.S. Pat. No. 3,917,055, VandenBerg et al, CAPSULE RECTIFICATION APPARATUS
U.S. Pat. No. 3,931,884, Edward M. Ackley, APPARATUS FOR TRANSPORTING AND ORIENTING CAPSULES
U.S. Pat. No. 4,069,753, Edward M. Ackley, deceased, APPARATUS AND METHODS FOR THE RANDOM SPIN PRINTING OF CAPSULES U.S. Pat. Nos. 3,931,884 and 4,069,753 show "spin printing" apparatus, and U.S. Pat. Nos. 2,785,786, 2,859,689, 3,026,792 and 3,424,082, show other apparatus and method for branding or printing indicia on the article.

All of the inventions described in the above-cited applications of the present inventor, as well as many of the prior art references cited deal with the basic problem of processing large numbers of similar objects, such as pharmaceutical capsules. It is necessary to print desired marking on the capsules. In order to do the printing, one must be sure that all the capsules are delivered to a printing apparatus, in the proper position. Since pharmaceutical capsules often have a body portion and a cap portion, it becomes necessary to print indicia on the capsules in the same relative position on all of the capsules.

Therefore, it is not enough merely to bring a capsule in close contact with a printing apparatus; it is also necessary to orient the capsule in the proper position relative to the printing means, so that the indicia will be printed on the capsule in the desired direction.

The process of orienting all capsules so that their body portions and cap portions point in substantially the same direction is known as "rectifying". Throughout this application, the use of the term "rectification" refers to the orientation of capsules such that corresponding parts of the capsules all point in the same direction.

In practice, it is necessary to transport, orient, and print many thousands of pharmaceutical capsules in a relatively short time. It is therefore necessary to use very high speed machinery, comprising rapidly rotating drums, as taught in the applications cited above, and it is thus necessary to effect rapid changes in the position of the capsules in order to accomplish the ultimate goals of the apparatus. When capsules are shifted from one position to another, the shifting must be accomplished in a relatively short time. The present invention discloses a new and useful improvement in the handling of such objects. As will be more fully explained below, the present invention takes advantage of both active means and passive means (such as gravity) for the rectification and the rapid and accurate handling of objects such as pharmaceutical capsules.

As will be more clearly apparent from the detailed description below, the present invention solves the above-mentioned problems in the handling of pharmaceutical capsules in a manner which is quite different from that shown in the prior art. The invention described herein is a rectifying apparatus and method, which relies in part on the action of gravity to accomplish the rectification. In contrast, a device such as shown in U.S. Pat. No. 3,871,295 to Ackley does rectify the capsules, but requires two separate air jets to accomplish the reorientation tasks. Also, the two separate air jet means are not identical, but instead are disposed so as to turn the capsules in different directions. The first air jet means 25 turns the capsules from a radial to a longitudinal position. The second air jet means 26 turns the capsules from a longitudinal to a transverse orientation. The present invention eliminates the need for use of two separate and distinct air jet means for this purpose.

Another device equipped to handle pharmaceutical capsules is that shown in U.S. Pat. No. 3,931,884 to Ackley. However, the invention disclosed in the latter patent does not rectify capsules at all, as stated in the introductory paragraph of the patent. Thus, although only one air jet means 26 is shown in the latter patent, it is also true that the capsules are disposed at random, and are not rectified before spin printing. The same comments apply to U.S. Pat. No. 4,069,753 to Ackley.

Still another example of a capsule orienting and turning apparatus is shown in U.S. Pat. No. 4,104,966 to Ackley et al. The capsules in the latter patent are rectified, but again, the rectification is accomplished by two separate air jet means disposed along the periphery of the drum.

Still another example of capsule handling machinery is shown in U.S. Pat. No. 4,167,226 to Ackley, which shows a device which does not rectify capsules, similar to those noted above. A single air jet means 26 is disposed along the capsule drum, and capsules are delivered to the spin printing station without regard to the orientation of their body portions and cap portions.

In contrast to the prior art noted above, the apparatus and method disclosed in the present application involves rectification of capsules wherein gravity is used to assist in the rectification. Capsules may then be delivered to a spin printer with all of the body portions and cap portions of the capsules pointing in the same direction.

SUMMARY OF THE INVENTION

The present invention comprises an apparatus and method for transporting, orienting, and if desired, often preferably spin printing a plurality of similarly shaped objects, such as pharmaceutical capsules. The apparatus comprises two drums. The first drum, known as a transfer drum, receives a plurality of capsules from a hopper disposed adjacent the transfer drum. The capsules slide by gravity out of the hopper towards the periphery of the transfer drum. A plurality of spaced apart pockets are disposed around the periphery of the transfer drum, each pocket comprising two intercommunicating portions, a radially disposed portion and a longitudinally disposed portion. The capsules enter the pockets, from the hopper, in a substantially radial orientation.

As the transfer drum is rotated, capsules which are seated in the radial portion of the pockets are shifted from the radial position to the longitudinal position. Shifting is facilitated by applying an air jet to the capsules so that the capsules pivot around the inclined surface linking the radial and longitudinal pocket portions, and so that the capsule is positioned longitudinally, fitting within the longitudinal portion of the pocket.

Optionally, to assist in the introduction of the capsules into their cavities, a vacuum chest is positioned immediately adjacent to the inner surface of the transfer drum.

Disposed along a portion of the periphery of the transfer drum is a back guide comprising a slot. The slot is shaped so that those capsules whose cap portions are pointed in the direction of motion of the transfer drum are held substantially in their current position. However, the slot is sufficiently wide such that those capsules whose body portions are pointed in the direction of motion are allowed to pivot, under the influence of gravity, thereby changing their orientation. After the capsules have travelled along approximately three quarters of the circumference of the transfer drum they are engaged by capsule cups mounted on a second drum, rotating in tangential relation with the transfer drum. The capsule cups are positioned to come into registry with the longitudinal pocket portions of the pockets of the transfer drum, and as the capsule cups come closer and closer to the transfer drum, the capsules are picked up by the cups such that those capsules whose body portions originally pointed in the direction of motion become oriented such that their cap portions are now pointed in the direction of motion. The orientation of those capsules whose cap portions were originally pointed in the direction of motion is not changed. Therefore, all capsules carried by the second drum point in the same direction.

The second drum, known as the cam drum, is so designated because the capsule cups are rotated by 90° by cam action. After the capsules are so rotated, they travel along the cam drum in a position transverse to their direction of motion. At this stage, all the cap portions of the capsules point in the same direction, that direction being determined by the direction in which the 90° rotation is made. These rotated capsules are then spin printed by a printing wheel rotating in tangential relation to the cam drum. Because all of the capsules have been oriented in the same direction by the time they reach the cam drum, the printing of indicia will be accomplished as desired, i.e. with the indicia appearing on the same part of each capsule.

Optionally the capsules are spin printed. Spin-printing can be performed in accordance and at locations as disclosed in prior art, such as in U.S. Pat. No. 3,871,295, where spin printing is carried out subsequent to delivery of the capsules to a conveyor means, after the capsules have been removed from the drum, which has been generally the practice. The apparatus of this invention is ideally suited for spin-printing of the capsules (or other like objects) while the objects are still travelling along the second drum, prior to delivery and removal from the confines of the pockets of the second drum.

Accordingly, the capsules may optionally be spin printed while traveling along the cam drum. As the capsules travel further, they fall by gravity (with the aid of another air jet) into a delivery chute.

Accordingly, it is an object of the present invention to provide an apparatus for transporting, orienting, and printing a plurality of similar objects, such as pharamceutical capsules.

It is a further object of the present invention to provide an apparatus as described above which is especially suited to the handling of capsules having a body portion and a cap portion.

It is a further object of the present invention to provide an apparatus and method for rectifying capsules before they are to be printed.

It is a further object of the present invention to provide an apparatus and method as described above, which takes advantage of both active means and passive means for maximizing the efficiency of handling large numbers of similar objects at extremely high speeds.

Other objects and advantages of the present invention will be apparent to those skilled in the art from a reading of the following brief description of the drawings, the detailed description of the invention, and the appended claims.

DETAILED DESCRIPTION OF THE INVENTION

While the invention is largely described in terms of pharmaceutical capsules, it is understood that the apparatus and method disclosed herein are suitable for other applications, and the adaptation of the invention to capsules is intended as illustrative only.

Figure 1:
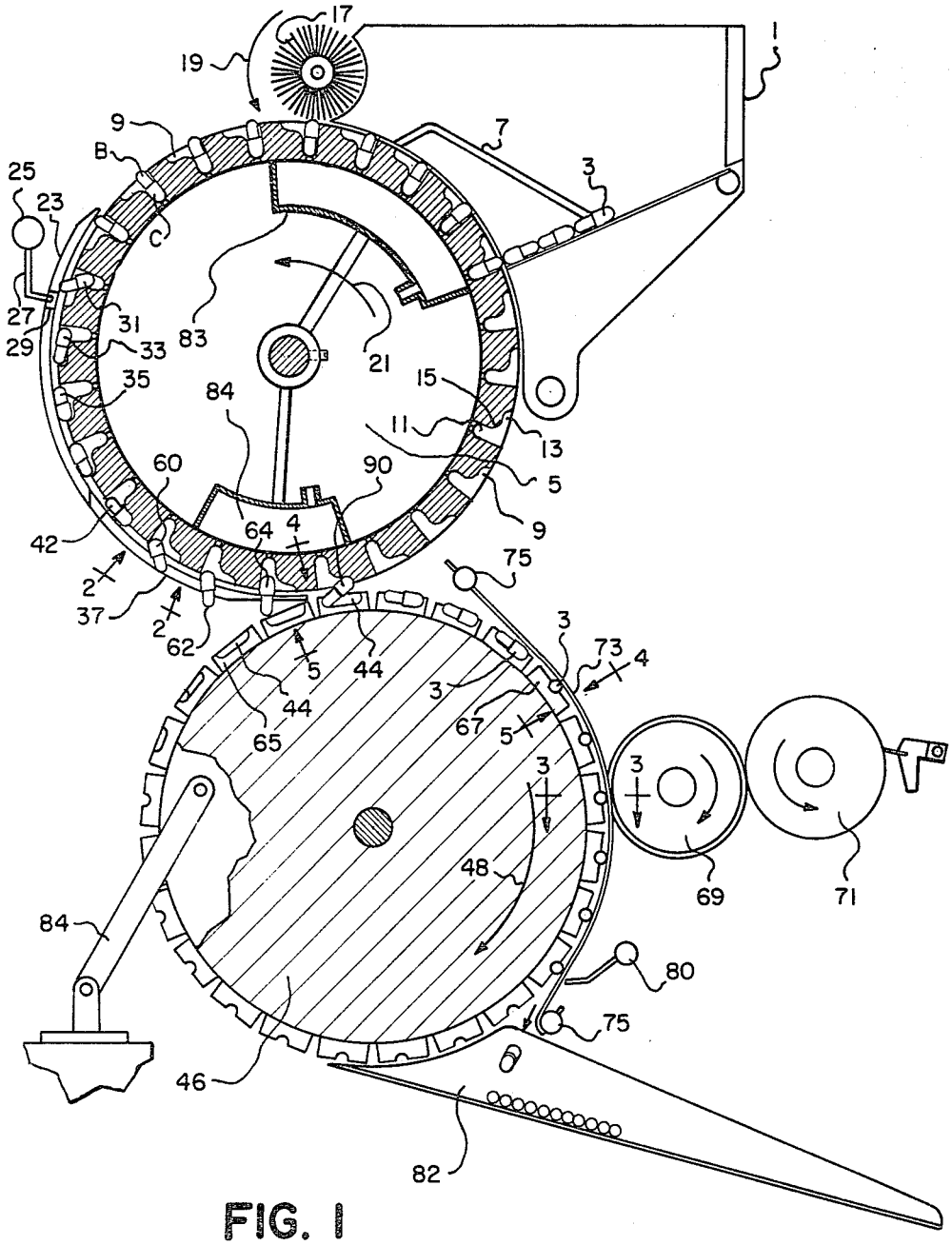
FIG. 1 is a cross-sectional view of the preferred embodiment of the invention.

The invention is best understood with reference to FIG. 1. A hopper 1 is used to deliver capsules 3 to transfer drum 5. The transfer drum is rotated by conventional means (not shown) in the direction indicated by arrow 21. Guide finger 7 guides the capsules 3 into the desired position on transfer drum 5. Disposed around the periphery of transfer drum 5 are a plurality of capsule pockets 9. Each of these pockets 9 comprises two portions, a radial portion designated by the reference numeral 11, and a longitudinal portion designated by reference numeral 13. Radial portion 11 and longitudinal portion 13 communicate with each other, especially with the help of inclined surface 15 which facilitates the pivoting of capsules, as will be explained more fully below.

While the cross-sectional view of FIG. 1 makes it appear that there is only one row of pockets 9 around the periphery of transfer drum 5, it should be understood that the transfer drum 5 may contain a plurality of parallel rows of pockets, depending on the length of the transfer drum. That is, the transfer drum 5 is actually a cylinder allowing for the simultaneous processing of many rows of capsules. Therefore, it is further understood that the components described herein (for example, guide finger 7), may be present in multiple quantities as necessary, depending on the number of rows of pockets on the transfer drum.

Brush means 17, which rotates in a direction shown by arrow 19, is used to assist in properly seating the capsules 3 in the radial portions 11 of pockets 9.

A vacuum chest 83 (stationary) can be positioned immediately adjacent to the inner surface of transfer drum 5 to assist in the introduction of the capsules into the cavities. The effect of the vacuum is effected through small holes which extend through inner portions of the transfer drum into the cavities. Such vacuum chest is known, as is disclosed in U.S. Pat. No. 3,871,295, for instance, which disclosure is incorporated herein by reference. The vacuum chest is especially helpful when the apparatus is operating at its higher speeds, as it is capable.

Also as shown in said U.S. patent, a warm air chest may be optionally built into the apparatus.

Back guide 23 is positioned along a portion of the periphery of transfer drum 5, being spaced apart from the transfer drum 5 by a substantially constant distance. The back guide helps to retain capsules in the desired positions, but also allows the capsules to move to a limited extent, as will be described below.

A means for assisting in shifting capsules from a radial to a longitudinal position is shown, in the preferred embodiment, as an air jet comprising a source 25 of compressed air and a conduit 27. Air is directed through a hole 29 in back guide 23 towards the capsule. The force of the air jet causes the capsule to pivot around the inclined surface 15, as shown by the capsule designated by reference numeral 31. The capsules also tend to pivot due to gravity, as the transfer drum continues to turn. Due to the presence of back guide 23 and inclined surface 15, capsule 31 can pivot only in the desired manner, i.e. from the radial to the longitudinal position. As the capsule 31 has passed beyond the air jet means, its position is substantially as shown by the capsules designated by numerals 33 and 35.

While the shifting means is shown as an air jet, it is understood that other embodiments can include other structures. For example, another brush means might be used to shift the capsules. Also, gravity alone could be used to shift the capsules in the manner shown.

All of the capsules 3 have two distinct portions, a body portion designated as "B" and a cap portion designated by "C". It is seen that the air jet means operates in the same manner on all capsules. Regardless of the initial orientation of body portions B and cap portion C, the capsule is shifted from the radial to the longitudinal position.

As can be seen from FIG. 1, capsules 3 originally enter transfer drum 5 in one of two orientations: either body portion B is pointing radially outward, or cap portion C is pointing radially outward. Therefore, after a given capsule is shifted from the radial position to the longitudinal position, it will be traveling with either the body portion B or the cap portion C pointed in the direction of motion of the capsule. The capsule designated 33 has its body portion pointing in the direction of motion. The capsule designated 35, on the other hand, has its cap portion pointed in the direction of motion.

Figure 2:
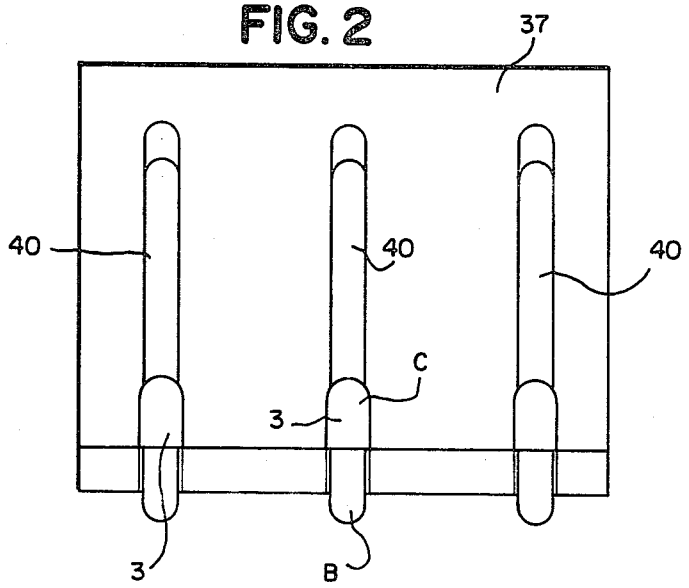
FIG. 2 is a cross-sectional view, taken along the line 2—2 of FIG. 1, showing the sizing section of the back guide, which permits the reorientation of some of the capsules.

Back guide 23 further comprises a sizing section 37, which is located at the end of the back guide farthest from the point at which the capsules enter the transfer drum pockets. The sizing section 37 is seen in cross-section in FIG. 2. FIG. 2 is constructed as if there were three parallel rows of capsules disposed on transfer drum 5. But, as stated above, the number of parallel rows of capsules handled can be varied, and is not material to the understanding of this invention.

Sizing section 37 defines slots 40, which are at least as wide as the diameter of body portions B of capsules 3, but which are narrower than cap portions C of capsules 3. If a capsule happens to be oriented in a manner similar to that of capsule 35, with its cap portion C pointing in the direction of motion, the body portion B (which is the trailing end of the capsule) will be prevented from falling into slot 40 because of the fit between cap portion C and the longitudinal portion of the pocket. As a result further movement and change in orientation of this capsule is prevented. The capsule is retained substantially in its orientation, i.e. with the cap portion pointing in the direction of motion.

Meanwhile, a cam drum 46 having a plurality of capsule carriers 65, each carrier having a capsule cup 44, rotates in the direction indicated by arrow 48. One of the capsule cups is moved into registry with the longitudinal portion of a pocket on the transfer drum 5. At this point, a capsule such as that indicated by reference numeral 90, falls by gravity into capsule cup 44. This capsule, as it is transported along the periphery of cam drum 46, is therefore still oriented so that its cap portion points in the direction of its motion.

If, however, a capsule has been traveling along the transfer drum with an orientation illustrated by that of capsule 33, i.e. with the body portion pointing in the direction of motion, the capsule will fall into the position illustrated at 60, because the narrower body portion fits within slot 40. Of course, although the body portion of capsule 60 falls downward, the capsule as a whole will not fall out of the apparatus because the cap portion still does not fit through slot 40. As shown by the capsules at 62 and 64, the capsules are allowed to fall, by gravity, into a substantially vertical position. Then, as a capsule cup 44 approaches the corresponding pocket along transfer drum 5, the capsule falls easily into capsule cup 44 in a position whereby its cap portion points in the direction of motion.

In short, it is seen that those capsules whose body portions pointed in the direction of motion along the transfer drum are reoriented so that these capsules have their cap portions pointing in the direction of motion along the cam drum. Therefore, it is also true that those capsules whose body portions were originally disposed radially outward are reoriented twice, once from the radial to the longitudinal position, and again from a position wherein the body portion points in the direction of motion to a position wherein the cap portion points in the direction of motion of the capsule. For those capsules whose cap portion originally pointed radially outward, there is essentially only one reorientation, namely the shift from radial to longitudinal positions. Thereafter, such capsules are maintained with the cap portion pointing substantially in the direction of motion.

Figure 4:
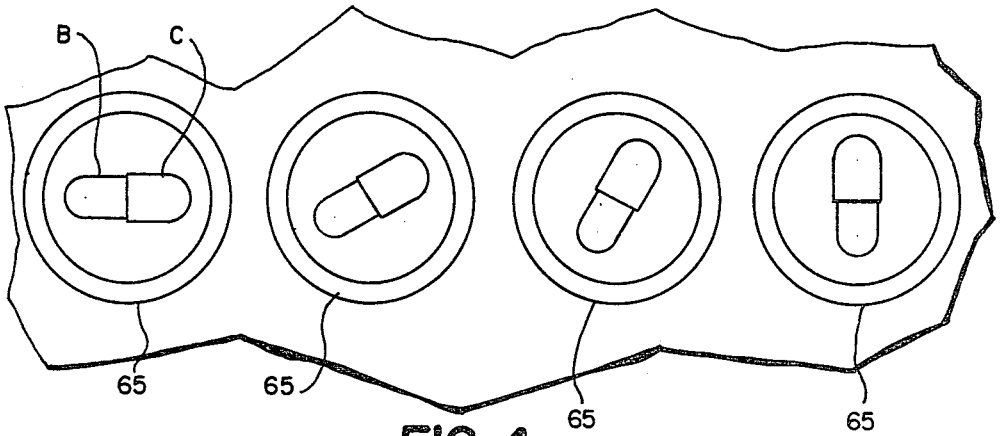
FIG. 4 is a fragmentary cross-sectional view, taken along the line 4—4 of FIG. 1, showing the turning of a capsule along the cam drum.
Figure 5:
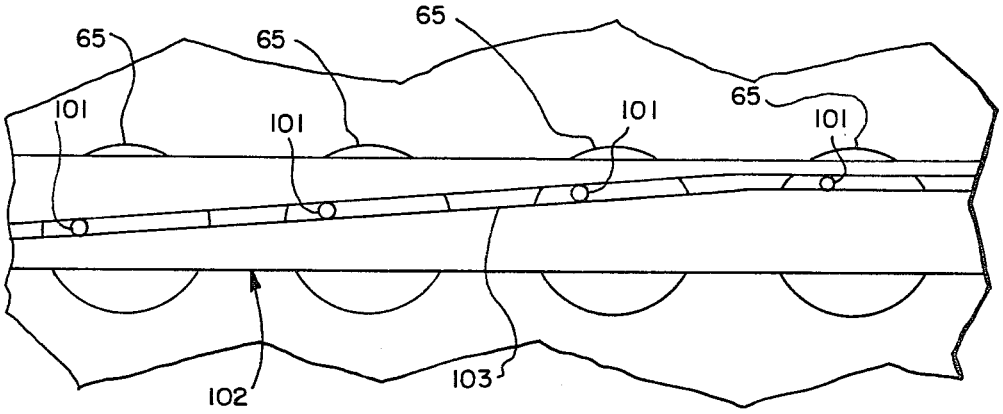
FIG. 5 is a fragmentary cross-sectional view, taken along the line 5—5 of FIG. 1.

Cam drum 46 is so named because the capsule cups 44 which are contained in capsule carriers 65, are rotated by cam action about a 90° angle as illustrated at 67. The direction of the 90° rotation is not important; what is important is that all of the capsules be oriented in the same manner for printing or other further processing. The type of cam device used to effect this rotation is illustrated in FIGS. 4 and 5. FIG. 4 is a fragmentary cross-sectional view showing a capsule in various stages of rotation. FIG. 5 shows precisely the cam action which causes the capsule to rotate in this manner.

In FIG. 4, a capsule carrier 65 is shown, containing a capsule with the body portion and cap portion designated as B and C, respectively. In the embodiment shown in FIG. 4, the capsule is rotated in a counterclockwise direction, through an angle of 90°. As stated above, the rotation could be done in a clockwise direction, as long as all capsules are treated in a similar manner.

FIG. 5 shows the underside of the capsule carriers 65. Each capsule carrier 65 has, extending from the carrier, a follower 101 which is offset from the axis of the carrier 65, and which acts as an eccentric. The follower 101 acts in combination with cam means 102 to cause the capsule carrier to rotate in the desired manner. Specifically, cam means 102 is arranged with a slot 103 through which followers 101 pass as cam drum 46 rotates causing capsule carriers 65 to rotate. Cam means 102 is mounted to the cam drum in a conventional manner as is more fully explained in U.S. patent application Ser. No. 065,337, now U.S. Pat. No. 4,266,478 cited above. In FIG. 4, it is seen that the capsule rotates in a counterclockwise direction. If it were desired that the capsule rotate in a clockwise direction, the camming surface, namely slot 103, would be arragned in FIG. 5 to slope downwardly.

Figure 3:
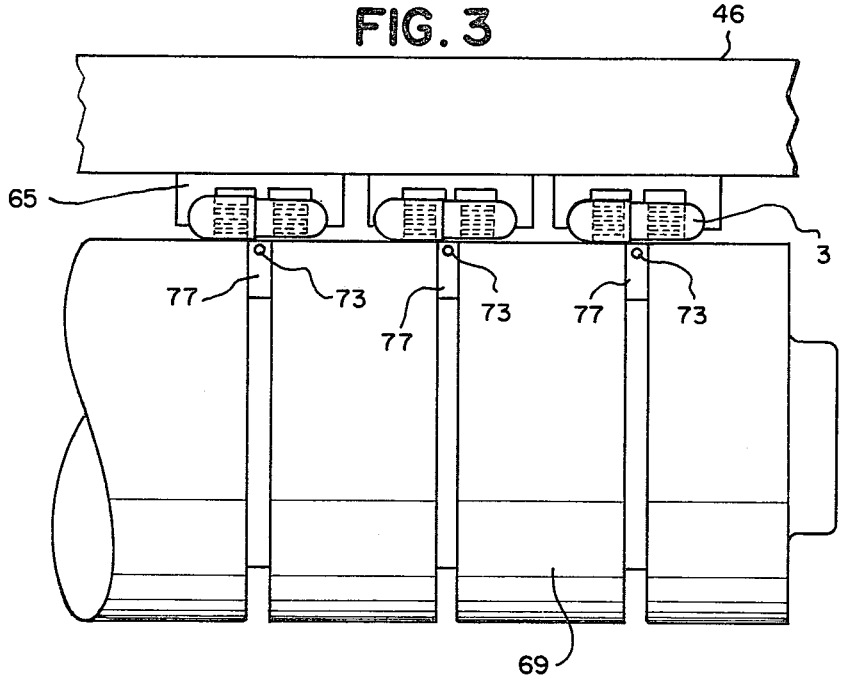
FIG. 3 is a cross-sectional view taken along the line 3—3 of FIG. 1, showing the point at which the spin printing means comes into tangential contact with the capsule carried along the cam drum.

The capsule carrier indicated at 67 shows a capsule which is oriented in a direction transverse to the direction of motion. Rubber print roll 69, which receives ink from roll 71, is used to spin print indicia onto the capsules. Wire guide 73, which is held in place by wire guide tension bars 75, is isued to maintain the capsules 3 in their proper positions without interfering with the spin printing operation. The position of wire guide 73 is better illustrated in FIG. 3, which shows that the wire guide 73 is located within a recessed area 77 within rubber print roll 69. FIG. 3 illustrates, by way of example, the use of three parallel rows of capsules, although the actual number of rows used can be varied, as already noted.

As disclosed earlier herein, the printing of indicia can be performed after the capsule has left the drum, or ideally, it can be performed as described above. It can be performed at both locations for different indicia.

After the capsules have been printed, they are ejected by air jet means 80, and fall by gravity into delivery chute 82.

A timing link 84 is provided to adjust the speed of the 90° rotation of the capsule carrier and capsule cup. Of course, it is necessary that, between the time the cap enters its cup at the point of tangency between the two drums, and the point at which the spin printing is accomplished, the capsule should have rotated exactly 90°.

It is believed that the present invention represents a patentably new advance over all three prior inventions of the present inventor, cited above. First, it is clear that the present invention is quite different from the single drum apparatus of Ser. No. 089,190, now U.S. Pat. No. 4,308,942. The latter application does not teach rectification, as the objects shown therein do not have distinguishable body portions and cap portions. Since the objects which are transported by the apparatus shown in Ser. No. 089,190, now U.S. Pat. No. 4,308,942 are generally symmetrical, there is no need to rectify them. Instead, the objects, after being shifted from the radial to the longitudinal position, are transferred to a carrier means without further orientation.

Both the two drum apparatus of Ser. No. 954,243, now U.S. Pat. No. 4,266,477, and the three drum apparatus of Ser. No. 065,337, now U.S. Pat. No. 4,266,478 show rectification of capsules having a body portion and a cap portion, similar to those processed by the apparatus of the present invention. However, in both of these earlier inventions, rectification is accomplished by distinct shifting operations on two separate drums. In the two drum apparatus of Ser. No. 954,243, now U.S. Pat. No. 4,266,477, those capsules whose body portions are initially disposed radially outward are shifted, while traveling along the first drum to a longitudinal position, and remain in this position until they approach the end of their journey along the second drum. Those capsules whose cap portions originally pointed radially outward are not shifted by the first drum, but instead are delivered to the second drum in a radial position, this with the body portion pointing radially outward. These capsules are then shifted to the longitudinal direction while traveling along the second drum. All capsules are then rotated to the transverse position by a combination of gravity and the shape of the back guide. The rectification is accomplished in a similar manner in the three drum case, Ser. No. 065,337, now U.S. Pat. No. 4,266,478, the rectification being accomplished along the first two drums. The third drum acts as a carrier for capsules, similar to that of the present invention.

The present invention is thus believed to be the first example of an apparatus whereby the capsules having body portions and cap portions are rectified while traveling along essentially only one drum. The capsules are delivered to the cam drum in substantially the same position, i.e. with the cap portions pointing in the direction of motion. This rectification is accomplished by a combination of the shifting of capsules from a radial to a longitudinal position, and by the reorientation of capsules with the assistance of gravity, so that a second drum (such as is taught in the prior two drum and three drum cases) is not necessary. It is noted that the second drum in the present invention, which is the cam drum, is not for rectification, but rather is for transporting, rotating and for assisting in spin printing of the capsules.

It is understood that many modifications are possible, within the scope of this disclosure. The above description of the preferred embodiment is intended as illustrative only. For example, the means for shifting the capsules from the radial to the longitudinal position may comprise an air jet emanating from the bottom of the pocket, tending to force the capsule out of the pocket. Or, the shifting means could be another brush, similar to the one already shown. Many other modifications and changes in design will be apparent to those skilled in the art from the above detailed description, and it is intended that such modifications be covered by the following claims.

What is claimed is:

1. Apparatus for transporting and orienting objects having telescoping cap and body portions, said apparatus comprising:

means for supplying objects having telescoping cap and body portions in random orientation;

transfer drum means having a plurality of pockets which receive said objects for delivering said objects to a delivery point, each of said pockets having a radial portion and a longitudinal portion disposed in the direction of movement of said transfer drum means;

rectifying means positioned adjacent a portion of said transfer drum means for restricting radially outward movement of said objects from said pockets and for orienting said objects in the same disposition at said delivery point, said rectifying means including a slotted section extending to said delivery point and having an open ended slot which has its open end at said delivery point and is aligned with said longitudinal portions of said pockets, said slot having a width larger than the body portions of said objects and smaller than the cap portions of said objects whereby said objects are oriented by permitting only said body portions to extend through said slot;

and carrier means for receiving said objects from said transfer drum means at said delivery point.

2. The apparatus of claim 1 further comprising air jet means positioned adjacent said transfer drum means for moving said objects radially outward.

3. The apparatus of claim 1, wherein the carrier means comprises a carrier drum means having a plurality of means defining cups for carrying the objects along the periphery of said carrier drum means.

4. The apparatus of claim 3, wherein said carrier drum means include cam means for rotating the cups through a 90° angle, whereby the objects traveling along said carrier drum means are oriented transversely to the direction of their initial motion along said carrier drum means.

5. The apparatus of claim 3, further comprising spin printing means for printing indicia on the objects, the spin printing means being positioned in tangential relation to said carrier drum means.

6. The apparatus of claim 1 wherein said transfer drum means rotate about a horizontal axis, said supply means are located above said horizontal axis, and said carrier means are located below said horizontal axis.

7. The apparatus of claim 6 wherein the open end of said slot is located in the vicinity of the lowermost rotational position of said transfer drum means.

8. The apparatus of claim 7 wherein said radial pocket portion is at the trailing end of said longitudinal pocket portion.

9. The apparatus of claim 8 wherein said rectifying means include a guide extending from above said horizontal axis of said transfer drum means to said slotted section of said rectifying means and spaced from said transfer drum means to restrict radially outward movement of said objects from said pockets.

10. The apparatus of claim 9 further comprising air jet means positioned adjacent said transfer drum means at said guide for moving said objects radially outward.

11. The apparatus of claim 10, further comprising air jet means for ejecting the objects from the cups on said carrier drum means after the objects have been printed.

12. The apparatus of claim 11, further comprising a rotatable brush, disposed in tangential relation to the transfer drum means, the brush being adapted to seat the objects received from the supply means in the radially disposed pockets along the transfer drum means.

13. The apparatus of claim 12, further comprising means for synchronizing the movements of said carrier drum means and the transfer drum means.

14. The apparatus of claim 13, wherein the cups are spaced, along the periphery of said carrier drum means, so as to coincide with the longitudinal portions of respective pockets in the transfer drum means.

15. The apparatus of claim 13, further comprising means for adjusting the timing of the rotation of the cups on the carrier means.

16. The apparatus of claim 15, wherein the spin printing means comprises a slot adapted to receive the wire guide.

17. The apparatus of claim 15, further comprising a wire guide for maintaining the objects in their cups while traveling along the periphery of said carrier drum means.

18. The apparatus of claim 17, further comprising tension means for holding the wire guide in position along the periphery of said carrier drum means.

* * * * *